US005085331A

United States Patent [19]

Groya et al.

[11] Patent Number: 5,085,331

[45] Date of Patent: Feb. 4, 1992

[54] SPOONING CLOSURE

[75] Inventors: Robert J. Groya, Norridge; Richard W. Hofmann, Chicago, both of Ill.

[73] Assignee: Magenta Corporation, Chicago, Ill.

[21] Appl. No.: 485,246

[22] Filed: Feb. 26, 1990

[51] Int. Cl.[5] ..... B65D 47/00

[52] U.S. Cl. ..... 215/245; 215/235; 215/237; 215/244; 215/329; 220/254; 220/334; 220/335; 220/339

[58] Field of Search ..... 215/235, 237, 238, 244, 215/245, 329, 228; 220/254, 291, 307, 326, 335, 336, 337, 339

[56] References Cited

U.S. PATENT DOCUMENTS

| | | | |
|---|---|---|---|
| 3,417,897 | 12/1968 | Johnson | 220/306 |
| 3,469,732 | 9/1969 | Foster | 220/324 |
| 4,144,985 | 3/1979 | Kinslow | 220/254 |
| 4,358,032 | 11/1982 | Libit | 222/498 |
| 4,361,250 | 11/1982 | Foster | 220/266 |
| 4,555,038 | 11/1985 | Nagel, Jr. | 215/235 |
| 4,714,181 | 12/1987 | Kozlowski et al. | 222/480 |
| 4,807,768 | 2/1989 | Gach | 215/216 |
| 4,898,292 | 2/1990 | VerWeyst et al. | 215/237 |
| 4,936,494 | 6/1990 | Weidman | 222/480 |

FOREIGN PATENT DOCUMENTS

| | | | |
|---|---|---|---|
| 1258979 | 1/1972 | United Kingdom | 220/339 |

*Primary Examiner*—Stephen P. Garbe
*Assistant Examiner*—Stephen K. Cronin
*Attorney, Agent, or Firm*—Laff, Whitesel, Conte & Saret

[57] ABSTRACT

A spooning closure generally comprising a skirt a top, a spooning opening and a hinged spooning lid which is adapted to pivot from a closed position to an open spooning position. Two locking means are provided, one of which is adapted to securely and releasably lock the spooning lid in the closed position and the other of which is adapted to securely and releasably lock the spooning lid in an open spooning position. The lock to hold the spooning lid in the open position is a combination of a spooning lid tongue and a friction engaging slot. The lock to hold the spooning lid closed includes an arcuate latch projection which extends at an acute angle to the spooning lid bottom surface and a cooperating keeper which partially defines the spooning opening and is formed by an arcuate cantilever. Also provided is a reinforcing web extending from the bottom of the spooning lid.

22 Claims, 5 Drawing Sheets

SPOONING CLOSURE

The present invention relates to a closure cap to be used with a container, and more specifically, to a spooning closure to be used in storing and spoon dispensing of the contents from a container.

BACKGROUND OF THE INVENTION

Containers are normally fitted with closure caps which are frequently molded plastic cap members. There are many examples of molded closures equipped with dispensing tops, including, for example, devices where a portion of the end piece or top of the dispensing cap is pivotable from a closed position to an open spoon dispensing position. The pivoting top is often difficult to work with because, after initially being opened, it is difficult to close and/or reopen. Another problem is that the pivoting top, when open, often tends to wave back and forth and thus obstruct the flow of the container contents being dispensed.

More recently, plastic material containers have been used which include tear away portions of the container, and such tear away portions may include both a portion of the side wall of the container and a portion of the top wall of the container. The tear away portions are frequently not desireable because, once opened, the containers may not thereafter adequately protect the remaining contents from environmental conditions such as moisture.

Foster U.S. Pat. No. 4,361,250 discloses a plastic closure cap which holds its pivotable flap in the closed position and provides a visual indication as to whether the product has been opened prior to purchase by a consumer. After an initial opening of the container, the pivotable flap may be releasably held in a closed position by lugs which engage the edge of an opening. Similarly, Kozlowski et. al U.S. Pat. No. 4,714,181 discloses a condiment bottle cap including a pivotable lid having a plurality of spaced flanges on the underside of the lid adapted to engage an edge of the hole opening with either an interference or friction fit. The disclosed caps do not include resilient means on their skirts to securely retain the flap in the closed position. In addition, neither patent provides means for retaining the flap in the open dispensing position.

Thus, a closure is not heretofore known which can readily and easily be opened and closed and which can be securely locked either in the closed or open dispensing position. It is therefore an object of this invention to provide a spooning closure having a hinged top which improves upon the prior art and which can readily be pivoted between a locked closed position and a locked dispensing position.

It is a further object to provide the above container closure cap with a reinforcing web which adds to the useful life of the closure cap and provides a means for securely locking the lid in a closed position.

SUMMARY OF THE INVENTION

In accordance with the above objects, a spooning closure is provided which generally comprises a skirt and a lid, a portion of the lid is adapted to pivot from a closed position to an open spooning dispensing position. A locking means is provided, which is adapted to securely and releasably lock the pivoting spooning lid in the closed position.

The spooning lid is generally arcuate and is hinged to a fixed portion of the lid. The closing lock is an arcuate closer projection that preferably extends at a predetermined acute angle from the bottom of the lid towards the edge of the spooning lid. The projection is adapted to engage the edge of the closure opening so as to extend below and outwardly of the closure opening. Also in combination with the lock is an arcuate seal which projects from the bottom of the lid and cooperates with the closure opening to provide a tight seal between the seal projection and the closure opening.

Another feature of the present invention is to provide a reinforcing web for the underside of the spooning lid. The web has at least one longitudinal reinforcing rib and at least two non-longitudinal reinforcing ribs intersecting the longitudinal reinforcing ribs. The reinforcing ribs are positioned to provide the desired rigidity to the spooning lid. They make the lid rigid so that when the user presses at the tip of the lid, the entire lid engages the sealing skirt forming the closure opening. This provides a tight seal between the spooning lid and the closure opening. Without the reinforcing ribs, the spooning lid would be flexible and it would be difficult to have a complete sealing along the entire radius of the spooning lid.

Another feature of the present invention is to preferably also provide a second lock to hold the spooning lid in a fully open position. In its full open position, the spooning lid will not interfere with spooning and will not block the user's view during spooning. This second lock is provided by having a tongue or projection extending a predetermined distance from the periphery of the spooning lid. The end of the tongue extends to or beyond a raised or upper skirt wall. The width of the tongue is slightly greater than a locking slot formed in the skirt upper wall. A closing slot is formed in the skirt upper wall diametrically opposite the locking slot. When the spooning lid is pivoted to its fully open position, the tongue is in the locking slot which locks the spooning lid in an open position. The second lock is provided by the tongue and the locking slot. The locking slot may have expansion slots formed in the skirt upper wall adjacent each end of the locking slot. This provides a gripping action between the skirt upper wall and the tongue when the tongue is in the locking slot. The locking slot in this instance has an opening which is slightly less than the width of the tongue.

Another second locking mechanism can also be provided by a pair of extensions extending inwardly a predetermined distance from the ends of the second slot. The slot is sized to frictionally engage the tongue and the distance between the extensions is slightly less than the width of the tongue to provide a gripping action between the pair of extensions and the sides of the tongue extensions.

In one preferred embodiment of the present invention, we provide a closing lock which has both the closing projection lock and a locking mechanism construction the same as the second locking mechanism.

The present invention and advantages thereof will become more apparent upon consideration of the following detailed description when taken in conjunction with the accompanying drawings.

DESCRIPTION OF THE PREFERRED EMBODIMENTS

Figure 1:
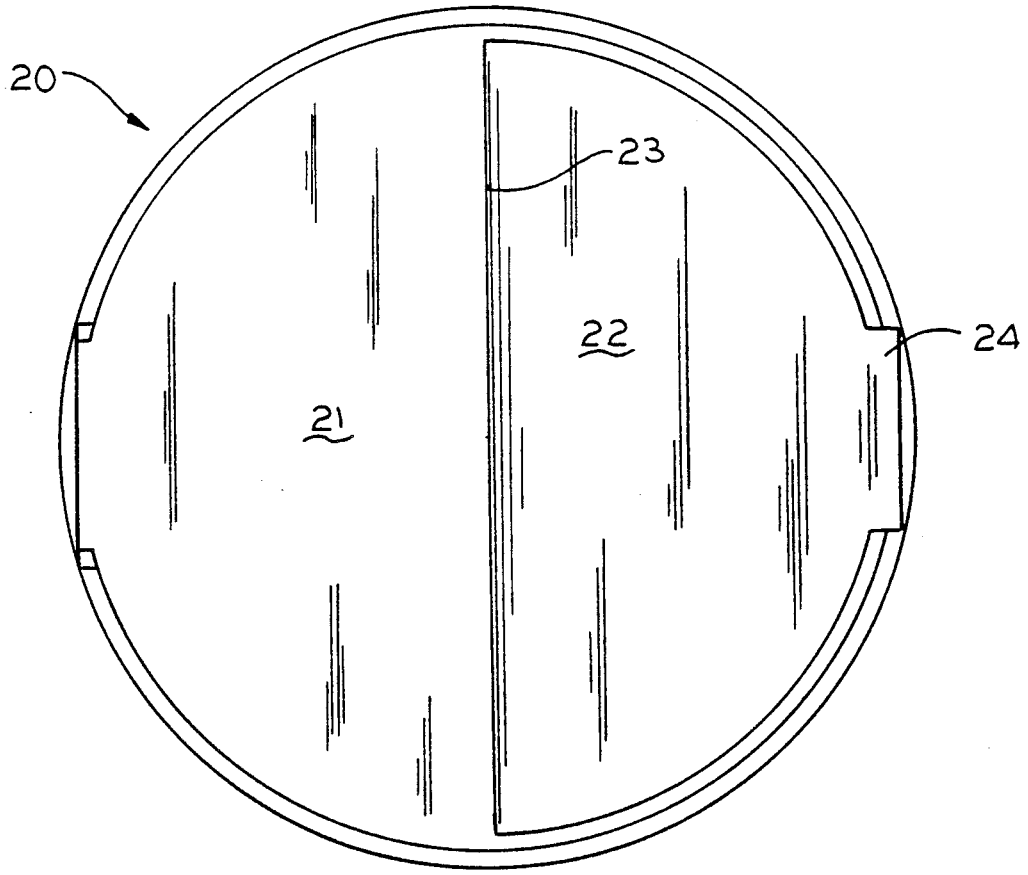
FIG. 1 is a top plan view of the spooning closure of this invention with the pivotable lid in a closed position.
Figure 2:
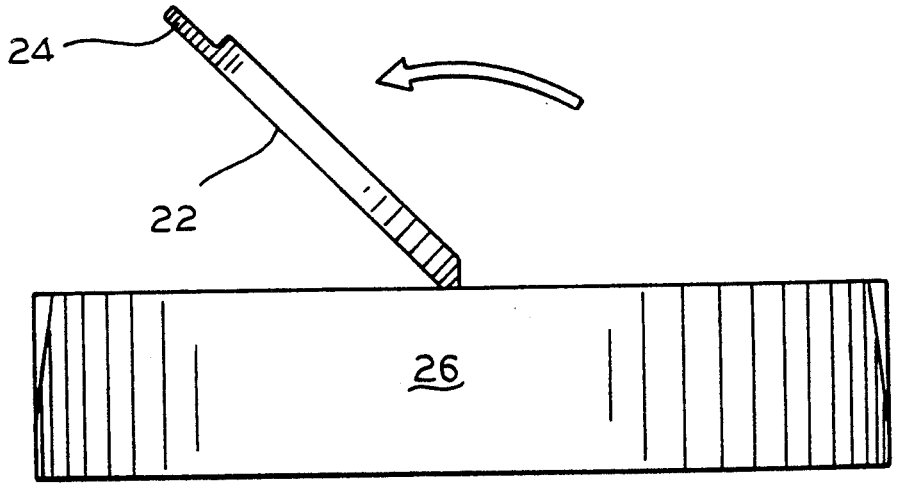
FIG. 2 is a side view of the spooning closure of FIG. 1, pivoted in a partially open position.
Figure 3:
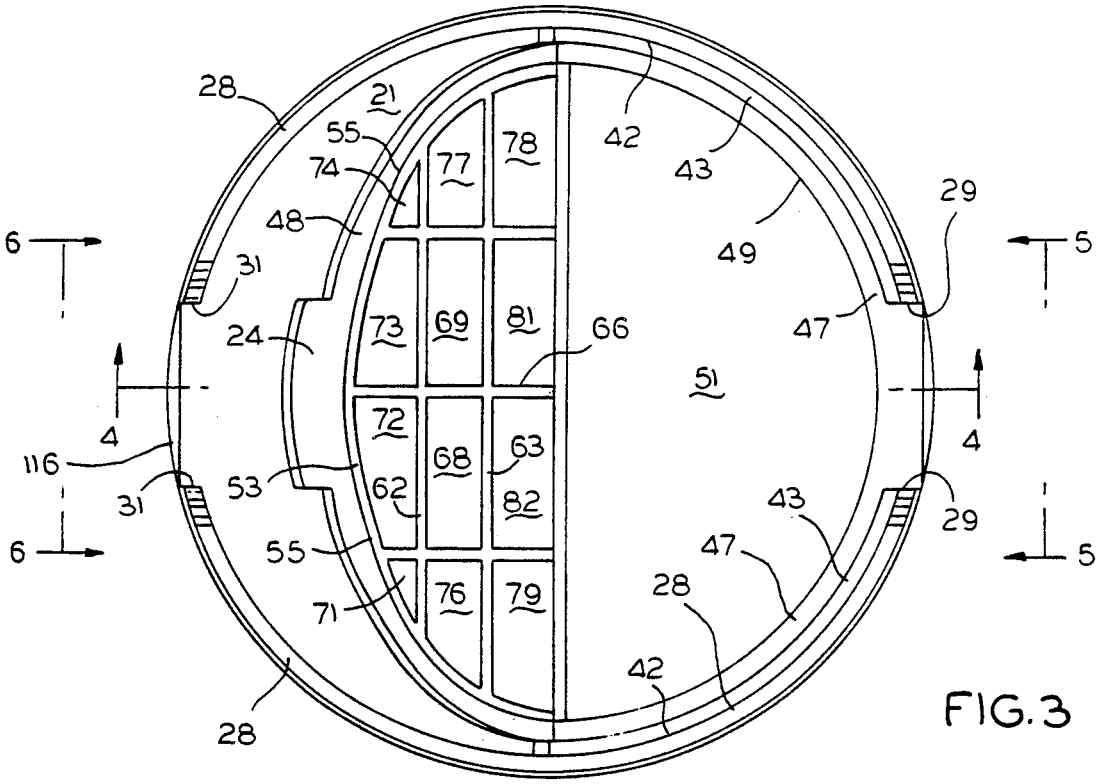
FIG. 3 is a top plan view of the spooning closure of FIG. 2.

FIG. 1-7 illustrates a spooning closure or cap 20 for a container. The spooning closure is especially useful for instant coffee jars, condiment jars, and the like which usually require the contents to be taken out of the container by a spoon.

Preferably, the spooning closure or cap is a one-piece molded plastic cap. In its preferred embodiment, the top 22, comprises a fixed portion 21 and a pivotable spooning lid 22, each of which is generally semicircular. A living hinge 23 connects the pivotable spooning lid 22 to the fixed portion 21 to pivot from a closed position to an open dispensing position.

Preferably, pivotable spooning lid 22 includes a tongue 24 which extends a predetermined distance from the end of the spooning lid to the outer periphery of the cap 20.

The cap has a skirt 26, which is annular. The skirt 26, FIG. 4 and 7, has a screw portion extending below the top which has internal screw threads 27. The skirt 26 is integral with fixed portion 21 and completely surrounds spooning lid 22 when the lid is in its closed position (FIG. 1). The skirt includes two arcuate walls 28 which extend a predetermined distance above and the top. The two arcuate walls 28 are separated from each other at each end to define a closing slot 29 and a locking slot 31. Another way of describing this would be to define the two arcuate walls 28 as a circular wall extending upwardly above the fixed top portion 21 for a predetermined distance and having two diametrically opposed slot 29 formed therein with one slots 29, 31 being a closing slot for the tongue 24 when the spooning lid 22 is closed. The other slot 31 is an opening lock slot being adapted to lock the tongue 24 therein. Preferably, the slots 29, 31 are substantially identical. However, an alterntative would be to have the closing slot 29 as shown in FIG. 5. The slot 29 in that embodiment is slightly larger than the width of the tongue 24 to permit the tongue to freely enter and exit the slot 29.

Figure 6:
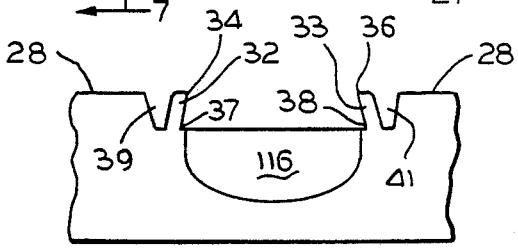
FIG. 6 is a partial side plan view of the spooning closure taken along lines 6—6 of FIG. 3.

The locking slots 29, 31 are best illustrated in FIG. 6. Each slot is formed by a pair of cantilevers 32 and 33 which are undercut facing ends of upper walls 28. The cantilevers 32 and 33 are undercut from about 3° to about 10° and preferably about 5°. Therefore, they are spaced apart at their top inner surfaces 34 and 36 a distance less than the width of the tongue 24 and at their bottom inner surfaces 37 and 38 they are spaced apart a distance which is substantially equal to or slightly larger than the width of the tongue 24. The cantilevers 32 and 33 are formed by slots 39 and 41 cut or formed in walls 28 to permit them to flex slightly outward to release or to grip the tongue upon application of a upward exiting or downward entering pressure to the tongue.

The slots 29, are adapted to receive and retain tongue 24 and thus lock spooning lid 22 in a fully open dispensing position wherein the lid 22 will not block the user's view nor interfere with the spooning.

The spooning lid 22 has a diameter less than the diameter of the inner surface 42 of the walls 28 and therefore provides the walls 28 with a pair of arcuate shoulders 43 that have inner surfaces 44 that abut the end of the spooning lid 22 when the spooning lid is in its closed position.

An inner arcuate seal 46 extends inwardly along the circumference of skirt 26 below the shoulders 43. The seal 46 has a semi circular upper arcuate surface 47 adapted to contact a lip portion 48 of the spooning lid. The inner ends 49 of the arcuate surface define the spooning opening 51. The sealing ring 46 has a bottom annular surface 52 which is adapted to contact the rim of a jar and form a seal with the jar when the cap 20 is screwed on the jar.

The locking device to releasably secure the spooning lid 22 in its closed position also includes an latch projection 53. The latch projection 53 extends from the inner surface of the spooning lid a predetermined distance outwardly towards the periphery of the spooning lid and acts as a latch for the lock. The arc of the latch projection 53 is substantially the same as the arc between the slot 29 or 31 of the spooning lid 22.

Figure 7:
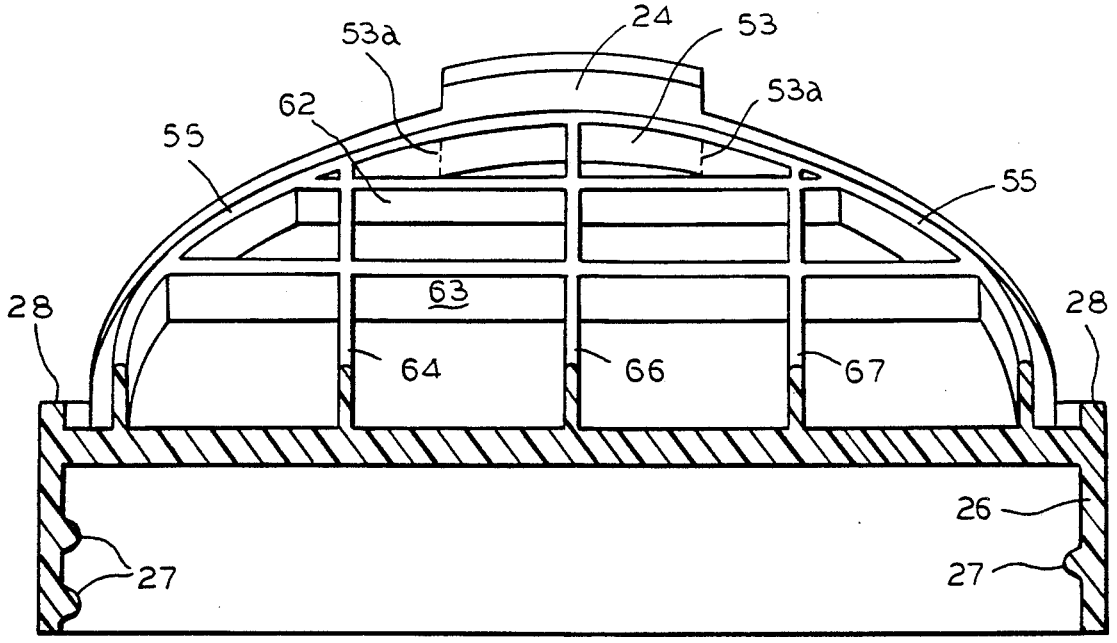
FIG. 7 is a cross section view of the spooning closure of taken along lines 7—7 of FIG. 4.

The ends of the latch projection 53 are shown by dotted lines 53*a* in FIG. 7. The latch projection 53 extends at an acute angle from the bottom towards the periphery of the spooning lid 22. The preferred acute angle is about 45°. However this may range from 40° to 60°.

Figure 4:
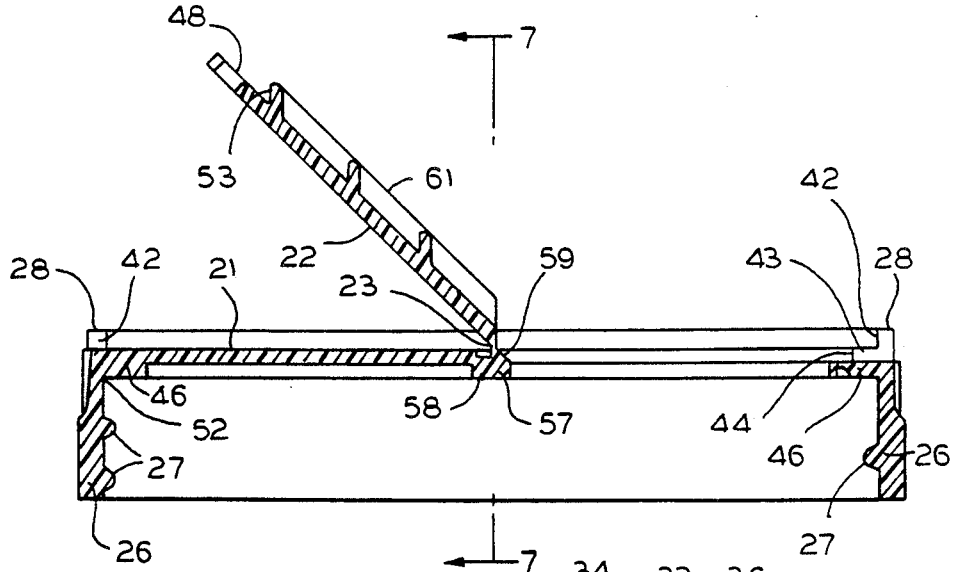
FIG. 4 is a cross sectional view taken along lines 4—4 of FIG. 3.
Figure 5:
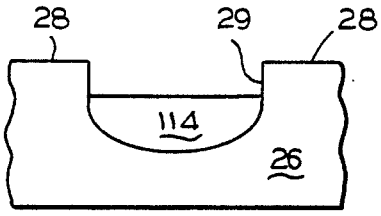
FIG. 5 is a partial side plan view of an alternative spooning closure taken along lines 5—5 of FIG. 3.
Figure 8:
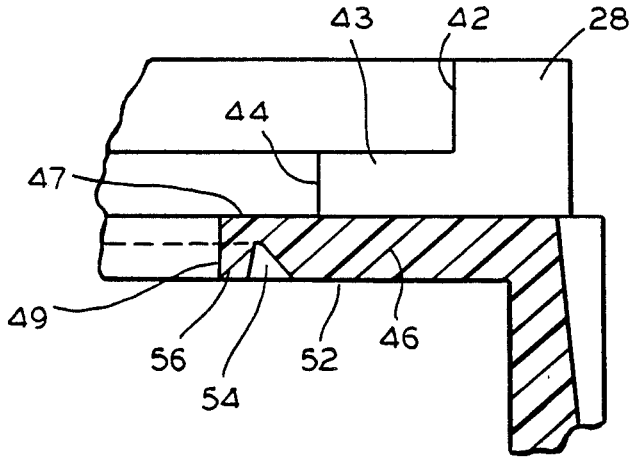
FIG. 8 is a partial enlarged view of the circled portion of FIG. 4.

Referring to FIGS. 4 and 8, the inner arcuate ends 49 of the sealing ring 46 have the bottom surface 52 cut or molded to form the notch 54 and an arcuate flexible keeper 56 which cooperates with the latch projection 53. The depth of the notch is preferably approximately half the thickness of the sealing ring 46 as shown in FIG. 8. The outer periphery of the keeper is surface 49 which defines the spooning opening 51. Notch 54 permits the keeper to releasably receive and engage latch projection 53 to secure pivotable spooning lid 2 in the closed first locked position. The keeper also engages seal projections 55 which project from the bottom of the lid and is integral with each end of latch projection 53. The seal projections 55 form a tight seal with cantilever end 56 formed by notch 54 when the lid is closed. Also, the cantilever end 56 which acts as a keeper and flexes to both secure and release the lid 22 upon application of downward or upward pressure.

The notch may have several embodiments, two of which are illustrated here. Also, the keeper may have several embodiments, two of which are illustrated here. The embodiment of FIG. 4 and 8 provides a flexible cantilever 56 which extends downward from the end of the upper surface 47. The notch 54 is generally triangular in construction. An outer side of the triangle extends at an angle from about 30° to about 60° and preferably about 45° measured from the horizontal axis, and an inner side of the triangle extends from about 10° to about 30° and preferably about 10° at an angle measured from the vertical axis. A flexible cantilever 56 is thereby formed by the notch 54. In any embodiment of the lock, the length of the arc of the latch projection 53 and cantilever end 56 may vary. The lid preferably has a reinforcing web as hereinafter described, to permit the entire lid to engage the corresponding seal upper surface 47 when the user presses the lid tongue to close the lid.

The cover 20 has a diametrically extending reinforcing strut or rib 57 extending below the hinge 23. The strut 57 has a bottom surface 58. The bottom surface 58 and bottom surface 52 are preferably in the same plane.

The hinge 23 is formed as part of the top of the strut 57 and the strut 57 has a declining or angular top wall 59 extending the length thereof. The angular top wall 59 is angled to accommodate the ends of a reinforcing web 61 as hereinafter set forth. The reinforcing web 61 is on the underside of the pivotal spooning lid 22.

The reinforcing web 61 extends from the bottom side of the pivotable spooning lid 22. The reinforcing web adds strength and rigidity to the spooning lid 22 and permits the lid to be easily and fully closed by pressing the tongue 24. The web 61 has two longitudinally extending ribs 62 and 63 that extend parallel to each other and parallel to hinge 23. The ribs 62 and 63 are chordal ribs extending between and connected to the reinforcing seal projections 55. The ribs 62 and 63 are preferably substantially equal in height to the projections 53 and 55. They preferably extend at an acute angle relationship with the spooning lid bottom surface as does projection 53.

Two inner rectangular wells 68 and 69 are formed by all the ribs. Four outer wells 71, 72, 73 and 74 are formed by ribs 62, 64, 66 and 67 and arcuate locking projection 53. Two outer wells 76 and 77 are formed by ribs 62, 63, 64 and 67 and arcuate sealing ribs 55.

Three spaced apart parallel non-longitudinal reinforcing ribs 64, 66 and 67 extend from the hinge to the inner surface of the projection 53. The ribs 64, 66 and 67 intersect the longitudinal ribs 62 and 63 and are preferably perpendicular to the ribs 62 and 63. The height of the ribs 62, 63, 64, 66 and 67 are preferably all substantially equal.

Two outer three sided wells, or recessed portions 78 and 79 are formed by ribs 63, 64 and 67 and arcuate ribs 55. Two three sided wells or recessed portions 81 and 82 are formed by ribs 63, 64, 66 and 67. Preferably, at least one reinforcing rib 66 in this embodiment is a radially extending rib.

As seen in FIG. 7, leading edges of the three ribs 64, 66 and 67 and the leading edges of the latch projection 53 may be radiused to facilitate the pivoting of the pivotable spooning lid 22. The reinforcing web 61 permits the entire radius of the latch to sealingly engage the sealing ring.

FIGS. 9–13 show other embodiments of our invention. In these Figures we show alternatives for the lock-sealing notch 54, the sealing keeper 56, and the reinforcing web 61 shown in FIGS. 1 to 8. It is to be understood that all or some of the alternatives are interchangeable in any of the embodiments. For instance, the construction of the sealing ring, keeper and notch of FIG. 8 may be replaced by the sealing ring, keeper and notch of FIG. 13 as hereinafter described or merely the notches may be substituted for each other. Where parts are substantially the same they are labeled with the same numbers.

Figure 9:
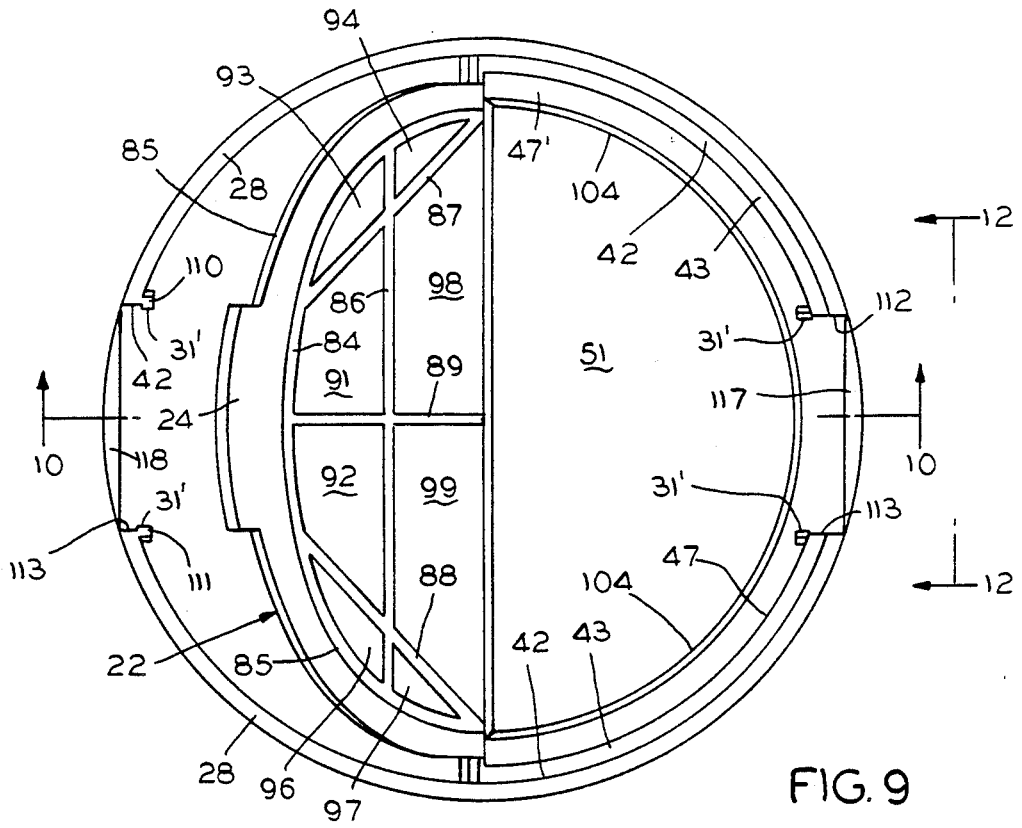
FIG. 9 is a top plan view of another spooning closure in its partially open dispensing position as illustrating in FIG. 2.
Figure 10:
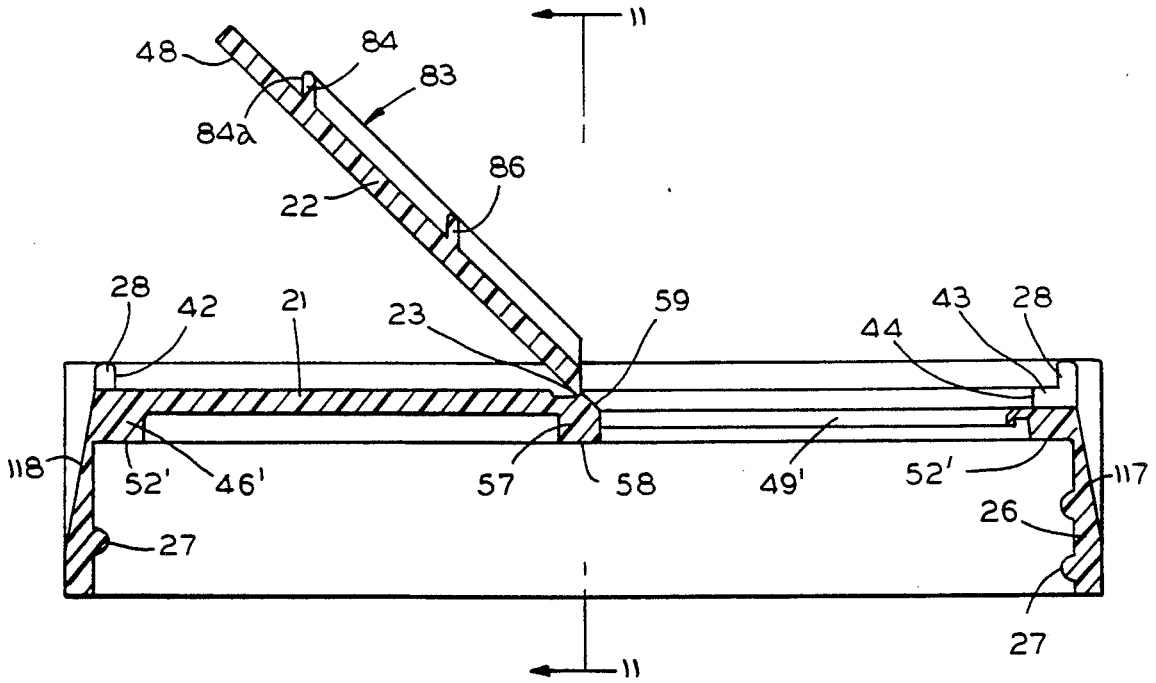
FIG. 10 is a cross section view taken along the lines 10—10 of FIG. 9.
Figure 11:
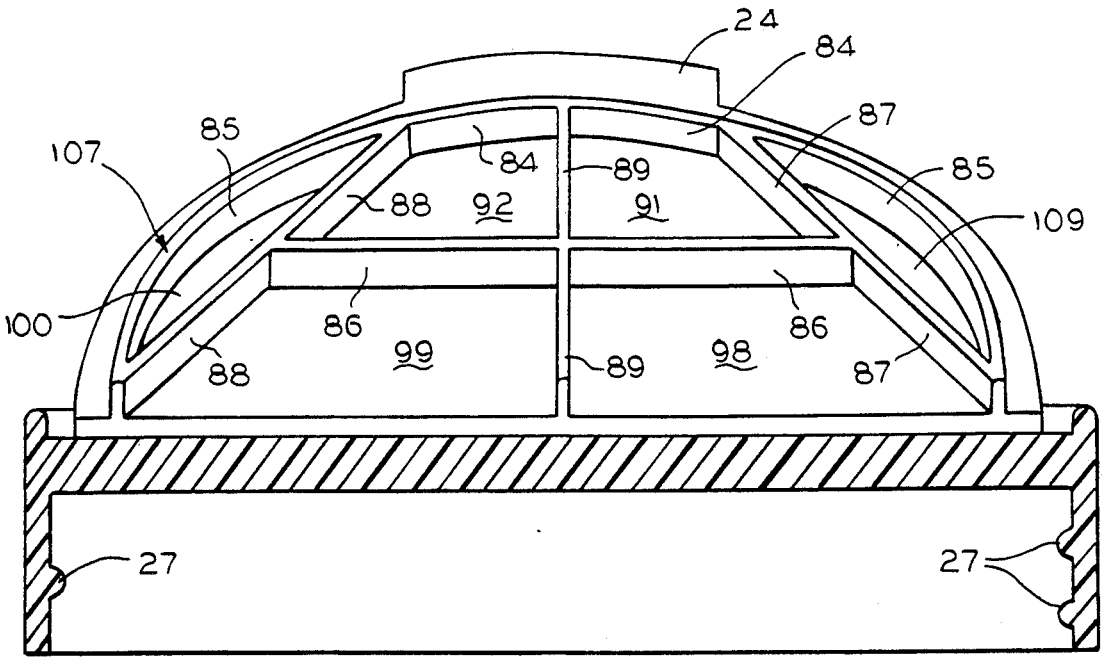
FIG. 11 is a cross-section view of the closure cap taken along lines 11—11 of FIG. 10.

FIGS. 9–11 illustrate the preferred type of reinforcing web 83 for the spooning lid 22. In this embodiment the underside of the spooning lid 22 is reinforced by the web 83. The outer circumference of the web 83 is formed by the projecting stop latch 84 which is angle with regard to the lid 22 and which is identical to the latch 53 shown in FIGS. 4 and 7. Therefore the above description therefore will not be repeated here. The arcuate reinforcing rib 85 cooperates with seal keeper 56 or 56' to provide a complete seal when the lid is closed. The web has one longitudinal reinforcing rib 86 spaced from the hinge 23 and preferably extending parallel to the hinge 23. A pair of non-longitudinal chordal ribs 87 and 88 extend from the ends of the hinge to the latch projection 84 and ribs 85 equidistant from a radial reinforcing rib 89. Rib 89 extends from substantially the center of the lid hinge 23 to the latch projection 84. The radial non-longitudinal reinforcing rib 89 intersects the longitudinal rib 86. The longitudinal rib 86 preferably has a height substantially the same as the height of the locking latch projection 84 and rib 85. The rib 86 extends at an angle to the spooning lid bottom surface as does the latch projection 84—an acute angle of from about 40° to about 60° and preferably about 45°.

The reinforcing ribs 86, 87, 88 and 89 and the arcuate locking projection 84 form two outer wells 91 and 92. Two outer three sided wells 93 and 94 are formed by ribs 86 and 87 and arcuate ribs 85. Two opposite outer three sided wells 96 and 97 are formed by ribs 86 and 88 and arcuate rib 85. Two lower three sided open wells 98 and 99 are formed by ribs 86, 87, 88 and 89.

Figure 13:
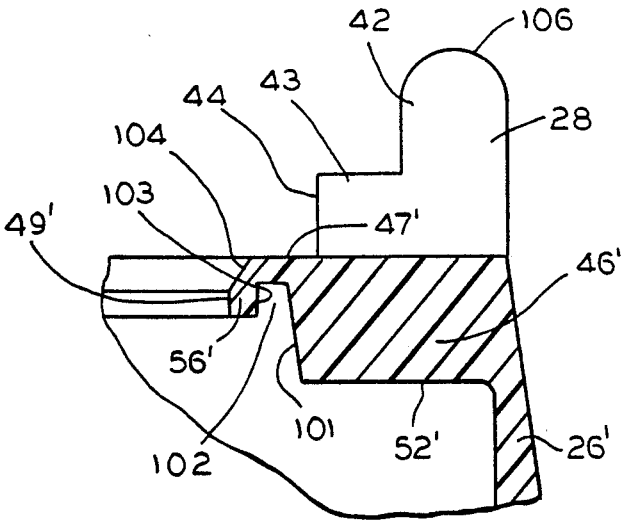
FIG. 13 is a partial enlarged view of the circled portion of FIG. 10.

Referring to FIGS. 9 and 13, an inner sealing ring 46' extends inwardly along the circumference of skirt 26' below shoulders 43. The sealing ring 46' has a semicircular upper arcuate surface 47' adapted to contact a lip portion 48 of the spooning lid 22. The inner ends 49' of the surface 47' define the spooning opening 51. The sealing ring 46' has a bottom annular surface 52' which is adapted to contact the rim of a jar and form a seal with the jar when the cap is screwed on the jar. In this embodiment the flexible seal and keeper 56' is formed by an integral projection which has the same top as surface 47' and its bottom is off-set from the inner end 101 of the sealing ring 46'. The flexible seal and keeper preferably extends half the thickness of the sealing ring. The flexible seal and keeper is formed by a substantially rectangular notch 102. This provides a flexible cantilever 56' which extends downwardly from the end of surface 47'. The cantilever 56' has an inner side 103 that extends at an angle of from about 0° to about 15° and preferably about 0° measured from the vertical axis. The end 101 of the sealing ring which extends into the notch 102 extends at an angle of from about 0° to 30° and preferably about 5° measured from the vertical axis.

In this embodiment, when the lid is closed, the locking projection 84 has its locking surface 84 engaging the cantilever 56' with its end **84*a* abutting or being close to the sealing wall end surface 101. The cantilever 56' also has a chamfered top wall 104 that eases the closing of the spooning lid 22 and aids in the sealing contact between ribs 85 and the cantilever seal 56'**.

This cap has the centered reinforcing skirt 57 below the hinge 23 and the skirt has angular top wall 59. The bottom surface 58 is preferably in the same plan as bottom surface 52'. The skirt top wall 28 has its end 106 rounded rather than flat as in FIG. 8.

In the embodiment of FIG. 11 the reinforcing web 107 has its longitudinal rib extending only to the ribs 87 and 88. Two end wells 108 and 109 are formed by the arcuate ribs 85 and the ribs 88 and 87 respectively.

Figure 12:
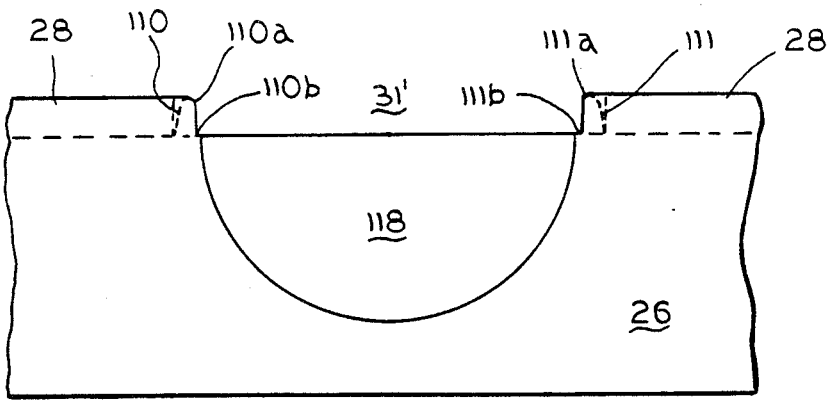
FIG. 12 is a partial side view of the closure cap taken along lines 12—12 of FIG. 9.

The locking slot 31', FIG. 9 and 12, is on both ends of the lid and is formed by a pair of extensions 110 and 111 extending inwardly from ends 112 and 113 of skirt wall 28. The extensions have chamfered surfaces or undercuts facing each other of from about 3° to about 10° and preferably about 5°. Their opposite sides are sloped from about 3° to about 10°. The top inner surfaces **110*a* and 111*a* are spaced apart a distance less than the width of the tongue 24 and at their bottom inner surfaces 110*b* and 111*b* the distance between them is substantially equal to or slightly greater than the width of the tongue. The distance between the ends 112 and 113 is substantially equal to the width of the tongue. Thus the slot 31' like the slot 31 (FIG. 3**) receives and retains the tongue and the spooning lid in a fully open dispensing position.

As is illustrated in FIGS. 3,5,6,8,9 and 12, the outer side of the skirt 26 adjacent each slot 29, 31 and 31' is provided with an indented portion 114, 116, 117 and 118 to allow a person to easily have access to the tongue 24 with their thumb without having an extending tongue.

Also we have illustrated the preferred embodiment where the spooning lid is only slightly smaller than the fixed top portion 21 so that when the spooning lid is locked in its fully open position it pivots approximately 180° and engages or touches the top surface of the fixed portion 21 and the tongue 24 is pressed into locking slots 31, 31'. In this fully opened locked position the spooning lid is held fully open without the user being required to hold the spooning lid.

In operation, internal threads 27 of closure cap 20 engage corresponding threads on a spout of a container. In its closed position, the pivotable spooning lid rests on inner arcuate surface 47, 47', tongue 24 is retained in the closing slots 29, 30, 31' and latch projection 53, 84 locking engages the flexible seal and keeper 56, 56'. To open the cap, the tongue is pried open upwardly by pressing with a thumb or the like on the bottom side of a leading edge of the tongue. An upward force is then exerted which releases the locking latch 53, 84. To facilitate spooning of the contents and eliminate holding the spooning lid open, the spooning lid is pivoted 180° so that the upper surface of the spooning lid engages or touches the stationary portion 21 and the tongue 24 is pressed into locking slot 31, 31' where it locks the spooning lid in place. Thereafter, the closure cap 20 may be returned to its closed position by again applying an upward pressure to the leading edge of tongue 24 which releases the tongue from the locking slot 31, 31' and it can then be placed in its closed lock position by pressing the spooning lid towards the spooning opening to lockingly engage the projection latch 53, 84 with the keeper 56, 56' and the projections 55 and 85 sealingly engage keeper 56, 56'.

It will be apparent that various embodiments may be resorted to without departing from the spirit and scope of the following claims.

We claim:

1. A spooning closure for a container comprising a top, a skirt, and a first and second locking means, the top including a fixed portion and a spooning lid pivotally hinged to the fixed portion, said spooning lid adapted to pivot from a closed position to an open dispensing position, said skirt being connected to said fixed portion, and bounding said spooning lid when in the closed position, said first locking means adapted to releasably lock said spooning lid in a closed position, said second locking means adapted to releasably lock said spooning lid in an open dispensing position, said second locking means comprises a tongue extending from said spooning lid and a locking slot formed on the top side of said skirt adjacent said fixed portion, said locking slot being sized to receive and frictionally engage said tongue.

2. The spooning closure of claim 1 wherein said locking slot is defined by a pair of flexible cantilevers.

3. The spooning closure of claim 2 wherein said flexible cantilevers are undercut from about 3° to about 10° and biased towards the center of said locking slot and wherein the distance between said cantilever inner surfaces at their upper ends is less than the width of said tongue.

4. The spooning closure of claim 1 wherein said locking slot is a pair of spaced apart extensions formed on said top wall fixed portion said tongue being positioned and sized to frictionally fit between said extensions when said spooning lid is pivoted to a desired open locked position.

5. The spooning closure of claim 4 wherein said extensions comprise inner surfaces undercut from about 3° to about 10° with the tops of said extension inner surfaces being spaced apart less than the width of said tongue, the first locking means includes a second locking means structure and has a latch projection extending in an arcuate direction on a bottom side of the spooning lid and a resilient cantilever extending in an arcuate direction adjacent an internal perimeter of said skirt, said latch extending at an acute angle from said bottom side toward a periphery of said spooning lid, and said cantilever being adapted to engage said latch projection and releasably lock said spooning lid in a closed position.

6. The spooning closure of claim 5 wherein a notch forms said cantilever and said cantilever is integral with an inner sealing ring which extends circumferentially around an inner sealing rim of the closure and said cantilever defines at least a portion of a spooning opening.

7. The spooning closure of claim 6 wherein said cantilever extends downward at an angle of from about 0° to about 15° measured from a vertical direction.

8. The spooning closure of claim 7 wherein said latch locking projection has an arc equal to or less than an arc of said tongue.

9. The spooning closure of claim 8 wherein said cantilever has a notch separating it from an end of said sealing ring and said notch has one side extending downward at an angle of from about 0° to about 30° measured from a vertical axis and an other side extending downward at an angle of from about 0° to about 60°.

10. The spooning closure of claim 6 wherein said notch is substantially rectangular in shape.

11. The spooning closure of claim 6 wherein said notch is substantially triangular in shape.

12. The spooning closure of claim 11 wherein the outer side of said triangular notch extends at an angle of from about 30° to about 60° measured from a horizontal direction and an inner side of said triangular notch extends at an angle of from about 0° to about 15° measured from a vertical direction.

13. The spooning closure of claim 2 wherein said closure is a one-piece molded plastic closure cap.

14. A spooning closure for a container comprising a circular top, a skirt, and a first and second locking means, said circular top including a substantially semicircular fixed portion and a substantially semicircular spooning lid pivotally hinged to the fixed portion, said spooning lid adapted to pivot from a closed position to an open dispensing position, said skirt being connected to said fixed portion, and bounding said spooning lid when in the closed position, said first locking means adapted to releasably lock said spooning lid in a closed position, said second lock adapted to releasably lock said spooning lid in an open dispensing position, wherein said spooning lid includes a reinforcing web on a bottom side thereof, said web having at least one arcuate locking projecting wall, at least one longitudinal wall and at least two non-longitudinal walls intersecting said longitudinal wall and connected to said locking projection wall.

15. The spooning closure of claim 14 wherein two web walls extend on a diagonal from said hinge to said latch projection and one web wall extends parallel to said hinge and two arcuate walls extending from said latch projection to said hinge.

16. A one-piece container closure having a top, a spooning opening defined in a portion of said top, a spooning lid pivotally hinged to said top and adapted to close said spooning opening, a releasable lock means to releasably hold said spooning lid in a closed position and an arcuate seal latch projection extending at an acute angle from a bottom surface of the spooning lid, wherein said accurate seal latch projection has an attached arcuate first end and a second arcuate free end, said spooning opening being positioned relative to said arcuate projection such that said second free end is larger than the opening, said opening being at least partially defined by a flexible cantilever extending downwardly from said top, said cantilever and said projection each extending in an arc substantially equal to an arc of the opening.

17. The one-piece container closure of claim 16 wherein said seal latch projection acute angle is from about 40° to about 60° and said spooning lid has a reinforcing web on the bottom surface thereof with said reinforcing web having at least one longitudinal reinforcing rib extending substantially parallel to said spooning lid hinge, said longitudinal rib extending at an acute angle of from 40° to about 60° from said bottom surface, at least one reinforcing rib extending perpendicular to and intersecting said longitudinal rib and being attached to said arcuate projection, and at least two non-longitudinal ribs intersecting said longitudinal rib and being attached to said arcuate projection.

18. The one-piece container closure of claim 17 wherein a notch forms said cantilever and said cantilever is integral with an inner sealing ring which extends circumferentially around an inner sealing rim of the closure and said cantilever defines at least a portion of a spooning opening.

19. The one-piece container closure of claim 18 wherein said cantilever extends downward at an angle of from about 0° to about 15° measured from a vertical direction.

20. The one-piece container closure of claim 19 wherein said notch is substantially rectangular in shape.

21. The one-piece container closure of claim 19 wherein said notch is substantially triangular in shape.

22. The one-piece container closure of claim 21 wherein said triangular notch comprises an outer side extending at an angle of from about 30° to about 60° measured from a horizontal direction and an inner side extending at an angle of from about 0° to about 15° measured from said vertical direction.

* * * * *